US008796527B2

(12) United States Patent
Okuyama et al.

(10) Patent No.: US 8,796,527 B2
(45) Date of Patent: Aug. 5, 2014

(54) TONE REPRODUCTION APPARATUS AND METHOD

(75) Inventors: Fukutaro Okuyama, Shizuoka-ken (JP); Shinya Koseki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 714 days.

(21) Appl. No.: 13/004,446

(22) Filed: Jan. 11, 2011

(65) Prior Publication Data

US 2011/0174137 A1 Jul. 21, 2011

(30) Foreign Application Priority Data

Jan. 15, 2010 (JP) ..... 2010-007150

(51) Int. Cl.
*G10H 1/08* (2006.01)
*G10H 7/00* (2006.01)

(52) U.S. Cl.
USPC ..... 84/625; 84/645

(58) Field of Classification Search
USPC ..... 84/625, 645
See application file for complete search history.

(56) References Cited

U.S. PATENT DOCUMENTS

| | | | | |
|---|---|---|---|---|
| 5,062,097 | A * | 10/1991 | Kumaoka | 369/70 |
| 5,189,237 | A * | 2/1993 | Koguchi | 84/609 |
| 5,300,725 | A * | 4/1994 | Manabe | 84/609 |
| 5,313,011 | A * | 5/1994 | Koguchi | 84/609 |
| 6,600,097 | B2 * | 7/2003 | Shiiya | 84/609 |
| 6,737,571 | B2 * | 5/2004 | Furukawa | 84/610 |
| 6,737,957 | B1 | 5/2004 | Petrovic et al. | |
| 7,304,227 | B2 * | 12/2007 | Hoguchi | 84/600 |
| 7,507,900 | B2 * | 3/2009 | Weir et al. | 84/610 |
| 7,552,336 | B2 * | 6/2009 | Kirovski et al. | 713/176 |
| 7,589,727 | B2 * | 9/2009 | Haeker | 345/440 |
| 7,612,276 | B2 * | 11/2009 | Hoguchi | 84/600 |
| 7,676,336 | B2 | 3/2010 | Herre et al. | |
| 2002/0026867 | A1 * | 3/2002 | Hasegawa et al. | 84/609 |
| 2002/0107691 | A1 * | 8/2002 | Kirovski et al. | 704/270 |
| 2004/0055444 | A1 * | 3/2004 | Ishii et al. | 84/604 |
| 2008/0027729 | A1 | 1/2008 | Herre et al. | |
| 2008/0083318 | A1 * | 4/2008 | Hoguchi | 84/600 |

(Continued)

FOREIGN PATENT DOCUMENTS

| | | | |
|---|---|---|---|
| CN | 1969487 | A | 5/2007 |
| CN | 101339790 | A | 1/2009 |
| JP | 2003163897 | | 6/2003 |
| JP | 2004158913 | | 6/2004 |

OTHER PUBLICATIONS

First Office Action, Chinese Patent Application No. 201110008711.X, Jun. 28, 2013.

(Continued)

*Primary Examiner* — Jeffrey Donels
(74) *Attorney, Agent, or Firm* — Harness, Dickey & Pierce, PLC

(57) ABSTRACT

Watermark information indicative of content of music piece performance data to be reproduced in synchronism with a first audio signal is embedded into the first audio signal, and the resultant signal is acquired as a second audio signal. In parallel to the above-mentioned processing, the watermark information is decoded from the second audio signal, the content of music piece performance data to be reproduced is identified on the basis of the decoded watermark information, and then a tone signal based on the music piece performance data is reproduced in accordance with the identified content.

13 Claims, 4 Drawing Sheets

(56) References Cited

U.S. PATENT DOCUMENTS

| | | | | |
|---|---|---|---|---|
| 2008/0172747 | A1* | 7/2008 | Hurtado et al. | 726/26 |
| 2008/0209219 | A1 | 8/2008 | Rhein | |
| 2009/0083541 | A1* | 3/2009 | Levine | 713/165 |
| 2011/0023691 | A1* | 2/2011 | Iwase et al. | 84/612 |

OTHER PUBLICATIONS

Office Action issued Feb. 4, 2014 in counterpart Japanese application, 4 pages.

Office Action issued Mar. 7, 2014 in counterpart Chinese application, 20 pages.

* cited by examiner

TONE REPRODUCTION APPARATUS AND METHOD

BACKGROUND

The present invention relates to apparatus and methods for reproducing a tone signal based on performance data, such as MID data, in synchronism with an audio signal.

Among examples of the conventionally-known techniques for reproducing, in synchronism with audio data, other music piece performance data is one disclosed in U.S. Pat. No. 7,026,537 corresponding to Japanese Patent Application Laid-open Publication No. 2003-316356 (hereinafter referred to as "the patent literature"). The technique disclosed in the patent literature is designed to store MIDI (Musical Instrument Digital Interface (registered trademark)) data in the LSBs (Least Significant Bits) of digital audio data and reproduce the individual data on the basis of association between these data.

In cases where music piece performance data and audio data are delivered via a communication network, such as the Internet, these data are sometimes compressed. However, with the technique disclosed in the patent literature, if audio data are compressed or converted into a tone signal of analog form, synchronized reproduction of the audio data may be undesirably prevented due to loss of necessary information for the synchronous reproduction.

SUMMARY OF THE INVENTION

In view of the foregoing, it is an object of the present invention to provide an improved technique for reproducing music piece performance data in synchronism with a tone signal on the basis of information obtained from the tone signal.

In order to accomplish the above-mentioned object, the present invention provides an improved tone reproduction apparatus for reproducing a first audio signal and a tone signal, based on music piece performance data, in synchronism with each other, which comprises: an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal; an audio reproduction section which reproduces the first audio signal on the basis of the second audio signal; a decoding section which decodes the watermark information from the second audio signal acquired by the acquisition section; and a tone reproduction section which identifies, on the basis of the watermark information decoded by the decoding section, content of the music piece performance data to be reproduced and reproduces the tone signal based on the music piece performance data in accordance with the identified content.

According to the present invention, watermark information indicative of content of music piece performance data to be reproduced in synchronism with the first audio signal is embedded into the first audio signal, and the resultant signal is acquired as the second audio signal, and the first audio signal is reproduced on the basis of the second audio signal. In parallel to the above processing, the watermark information is decoded from the second audio signal, the content of music piece performance data to be reproduced is identified on the basis of the decoded watermark information, and then a tone signal based on the music piece performance data is reproduced in accordance with the identified content. In this way, the present invention can reproduce a tone signal based on the music piece performance data in synchronism with the first audio signal.

In an embodiment, a plurality of the watermark information is embedded in correspondence with a plurality of reproduction time positions along the time axis of the first audio signal, and each of the watermark information identifies at least one tone.

In an embodiment, the content of the music piece performance data indicated by the watermark information includes identification information identifying a music piece, and position information indicative of reproduction time positions of the music piece identified by the identification information. The tone reproduction section includes: a storage section which stores therein the music piece performance data; and a readout and reproduction section which reads out, from the storage section, the music piece performance data of the music piece identified by the identification information included in the decoded watermark information and then reproduces a tones signal, corresponding to any one of the reproduction time positions indicated by the position information included in the watermark information, on the basis of the read-out music piece performance data.

The present invention may be constructed and implemented not only as the apparatus invention as discussed above but also as a method invention. Also, the present invention may be arranged and implemented as a software program for execution by a processor such as a computer or DSP, as well as a storage medium storing such a software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

Figure 1:
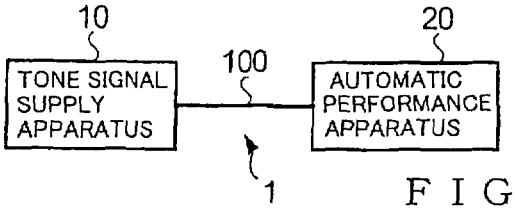
FIG. 1 is a block diagram showing a general setup of an embodiment of a reproduction system of the present invention.

FIG. 1 is a block diagram showing a general setup of an embodiment of a reproduction system 1 of the present invention. The reproduction system 1 includes a tone signal supply apparatus 10 and an automatic performance apparatus 20 interconnected via an audio cable 100. The tone signal supply apparatus 10 is an example of a tone signal supply apparatus of the present invention, which outputs a tone signal to the automatic performance apparatus 20 via the audio cable 100. The automatic performance apparatus 20 is an example of a reproduction apparatus of the present invention, which is, in this case, an electronic piano having an automatic performance function. The term "tone signal" is used herein to refer to a waveform signal of analog form indicative of a waveform of a tone.

Figure 2:
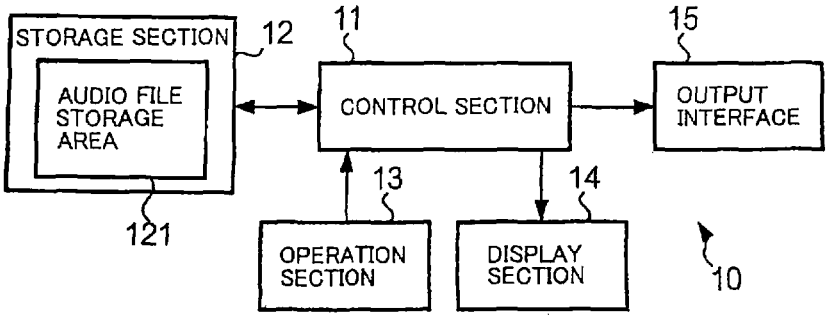
FIG. 2 is a block diagram showing a general setup a tone signal supply apparatus in the embodiment of the reproduction system.

FIG. 2 is a block diagram showing a general setup of the tone signal supply apparatus 10, which includes a control section 11, a storage section 12, an operation section 13, a display section 14, and an output interface 15.

The control section 11 includes a CPU (Central Processing Unit), a ROM (Read Only Memory) and a RAM (Random Access Memory). Using the RAM as a working area, the CPU executes a program, stored in the ROM, to control various components of the tone signal supply apparatus 10. The storage section 12, which is a storage section including, for example, a hard disk device, stores therein programs for the control section 11 to perform various control operations and has an audio file storage area 121 having audio files stored therein. The operation section 13 includes, for example, a keyboard, mouse, etc., and once operated by a user or human operator or player, it outputs, to the control signal 11, an operation signal corresponding to the user's operation. The display section 14, which includes, for example, a liquid crystal display, display various information. The output interface 15, which is an example of an output section and to which is connected the audio cable 100, outputs a tone signal, supplied from the control section 11, to the automatic performance apparatus 20 via the audio cable 100.

Figure 3:
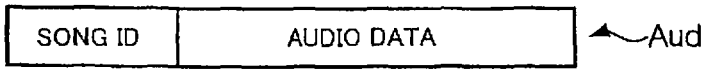
FIG. 3 is a diagram explanatory of a construction of an audio file stored in the tone signal supply apparatus in the embodiment of the reproduction system.

FIG. 3 is a diagram explanatory of a construction of one of audio files Aud stored in the audio file storage area 121. The audio file Aud includes information of a song ID and audio data stored in association with each other. The song ID is a unique ID identifying a song or music piece, and the audio data are a set of data indicative of a time series of sounds to be generated by a musical instrument performance and/or singing of a given music piece. The audio data represent digital data obtained by sampling an analog waveform in accordance with a particular sampling frequency (e.g., 44.1 kHz) and quantizing the sampled results. The song data ID is identification information uniquely identifying one of the audio files stored in the audio file storage area 121.

Figure 4:
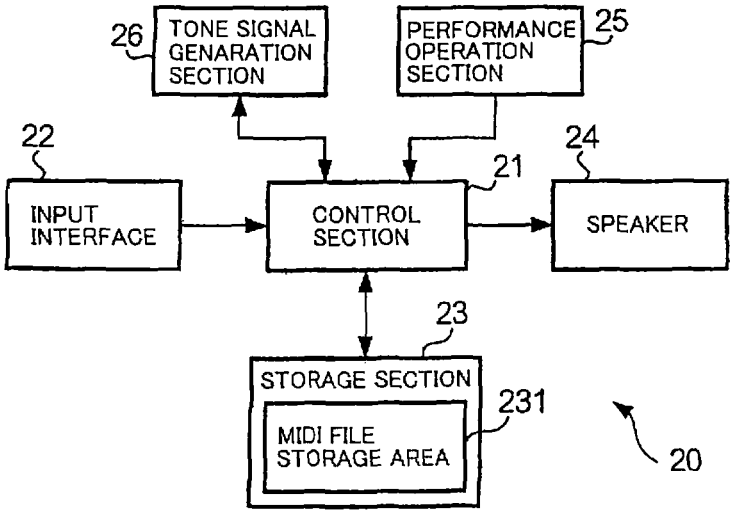
FIG. 4 is a block diagram showing a general hardware setup of an automatic performance apparatus in the embodiment of the reproduction system.

FIG. 4 is a block diagram showing a general hardware setup of the automatic performance apparatus 20. The automatic performance apparatus 20 includes a control section 21, an input interface 22, a storage section 23, a speaker 24, a performance operation section 25 and a tone signal generation section 26.

The control section 21 includes components for realizing or implementing a function as a sequencer (MIDI sequencer in this case) as well as components similar to those of the control section 11 of the tone signal supply apparatus 10. A CPU of the control section 21 executes a program, stored in the ROM or storage section 23, to control various components of the automatic performance apparatus 20. The input interface 22 is an input terminal into which is connected the audio cable 100. A tone signal supplied from the tone signal supply apparatus 10 is input to the input interface 22. The storage section 23, which is a storage section including, for example, a hard disk device, stores therein programs for the control section 21 to perform various control operations and has a MIDI file storage area 231 having MIDI files stored therein. The speaker 24 is a sounding device for audibly generating a tone in accordance with a reproduced tone signal by the control section 21 and MIDI data that are an example of music piece performance data. The performance operation section 25, via which the human player executes performance operation or which accepts operation by the human player, includes a performance controller, such as a piano keyboard having a plurality of keys, sensors for detecting performance operation, a drive circuit for depressing any one of the keys even without human player's performance operation, etc. Once performance operation is executed by the human player, the performance operation section 25 detects the human player's performance operation via the sensor and outputs, to the control section 21, performance information indicative of the detected performance operation. The tone signal generation section 26, which includes a tone generator circuit and a DSP (Digital Signal Processor), generates a tone signal corresponding to the performance information supplied from the control section 21 by performing sound processing in accordance with the supplied performance information and then outputs the generated tone signal to the control section 21. The control section 21 outputs the tone signal to the speaker 24 so that the speaker 24 audibly generates a tone corresponding to the tone signal.

Figure 5:
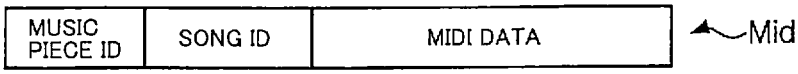
FIG. 5 is a diagram explanatory of a construction of a MIDI file stored in the automatic performance apparatus.

FIG. 5 is a diagram explanatory of a construction of one of the MIDI files stored in the MIDI file storage area 231. The MIDI file Mid, corresponds, for example, to a music piece, has pieces of information of a music piece ID, song ID and MIDI data (i.e., music piece performance data) stored in association with one another. The music piece ID is identification information uniquely identifying the MIDI file. The MIDI data are performance control information including "events" instructing performance control, such as generation and deadening, of particular tones and delta times each indicative of a generation time interval between the events. The song ID corresponds to the song ID assigned to the audio file Aud stored in the audio file storage area 121; that is, the audio file and the MIDI file having the same song ID correspond to the same music piece. The song ID is identification information assigned to permit selection as to which MIDI data should be reproduced when the audio performance apparatus 20 reproduces tone signals generated on the basis of the audio file Aud. In this specification, a "music piece (or song)" may be either one musically-complete music piece, or one or more musical phrases rather than such a musically-complete music piece.

The MIDI file storage area 231 constructed in the aforementioned manner is an example of a music piece performance data storage section of the present invention.

The following describe functions implemented by the tone signal supply apparatus 10 and automatic performance apparatus 20.

[Tone Signal Supply Apparatus 10]

Figure 6:
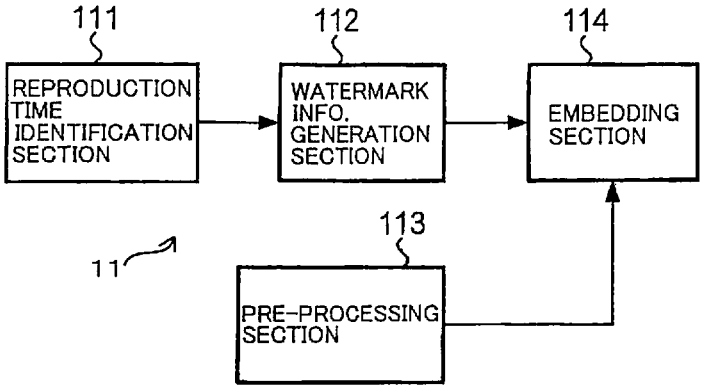
FIG. 6 is a functional block diagram showing functions implemented by a control section of the tone signal supply apparatus.

First, the functions implemented by the tone signal supply apparatus 10 will be described. FIG. 6 is a functional block diagram showing the functions implemented by the control section 11 of the tone signal supply apparatus 10. The control section 11 performs functions of a reproduction time identification section 111, watermark information generation section 112, pre-processing section 113 and convoluting or embedding section 114. A tone signal (or audio signal) which is a signal before being embedded with watermark information and which is to be processed in each of the above-mentioned functional sections will hereinafter be referred to as "first tone signal" (or first audio signal). The control section 11 reads out, from the audio file storage area 121, an audio file Aud designated by the user operating the operation section 13 and generates a first tone signal on the basis of audio data included in the read-out audio file Aud.

The reproduction time identification section 111 identifies a reproduction time (i.e., reproduction time position) indicative of a reproduction time position of the first tone signal. Let it be assumed that the reproduction time is indicative of a time position based on a start position ("0:00" in this case) of the audio data. The reproduction time identification section 111 can identify each reproduction time with reference to the audio file Aud.

The watermark information generation section 112 generates watermark information to be convoluted or embedded into the first tone signal. In this embodiment, the watermark information is a bit sequence including a song ID and position information indicative of reproduction times (i.e., reproduction time positions); such position information will hereinafter be referred to as "time codes". The watermark information generation section 112 can identify the song ID from the audio file Aud.

The pre-processing section 113 includes, for example, an LPF (Low Pass Filter) and performs pre-processing on the first tone signal. More specifically, the pre-processing section 113 performs, as the pre-processing, a filtering process on the first tone signal using the LPF to thereby cut off, from among frequency components of the first tone signal, frequency components included in a frequency band into which the watermark information is to be embedded. Namely, the LPF has a cutoff frequency Fo.

The embedding section 114 convolutes or embeds, into the first tone signal having been subjected to the aforementioned pre-processing, watermark information indicative of content of music piece performance data that are to be reproduced in synchronism with the first tone signal. In the instant embodiment, the embedding section 114 is constructed to embed the watermark information into a frequency band higher than the frequency components of the first tone signal, by performing phase modulation of a carrier wave signal, indicative of a carrier wave for carrying the first tone signal, on the basis of the watermark information. The first tone signal having the watermark information embedded therein in the aforementioned manner will hereinafter referred to as "second tone signal" (second audio signal). In other words, the second tone signal (second audio signal) is a tone signal obtained by synthesizing together the first tone signal and a waveform signal indicative of a wave of the watermark information.

Note that, in the case where the audio data comprise a plurality of channels, the embedding section 114 only has to generate a second tone signal by embedding the watermark information into the first tone signal of at least one of the channels.

Figure 7:
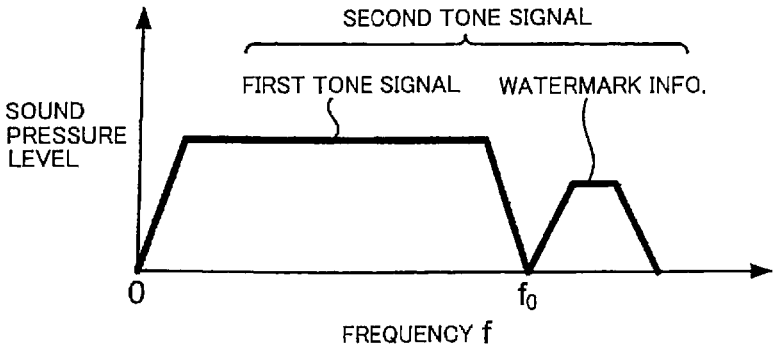
FIG. 7 is a graph explanatory of a construction of a second tone signal.

FIG. 7 is a graph explanatory of a construction of the second tone signal, in which the horizontal axis represents frequencies f while the vertical axis represents sound pressure levels of frequency components. As shown in FIG. 7, the second tone signal includes the frequency components of the first tone signal in a frequency band lower than the frequency fo, and the frequency components of the watermark information in a frequency band higher than the frequency fo. In other words, the frequency components of the first tone signal are included, for example, in an audible range (about 20 Hz to 20 kHz), and the watermark information is embedded in a frequency band higher than the audible range. It is preferable that the frequency fo be outside the audible range, for example, higher than 20 kHz. Because, even when a tone corresponding to the second tone signal has been audibly generated, no sound corresponding to the watermark information can be audible to the ears of persons, and thus, the watermark information has little auditory influence. For example, in a case where the watermark information embedded in a frequency band outside the audible range cannot be maintained due to characteristics of an encoder at the time of compression of the tone signal. A/D converter to be used for analog-to-digital conversion, etc., the watermark information may be embedded in a relatively low frequency band, such as 15 kHz or over. In short, it is preferable that the watermark information be embedded in a frequency band that is higher than the frequency components of the first tone signal and that has little auditory influence.

The output interface 15 of the tone signal supply apparatus 10 outputs the second tone signal, which is a tone signal embedded with the watermark information by the embedding section 114, in such a manner that the control section 21 of the automatic performance apparatus 20 can acquire the output second tone signal. The control section 11 of the tone signal supply apparatus 10 performs the processes, implemented by the aforementioned functions, on the first tone signal supplied per given processing unit, to thereby generate the second tone signal to be output to the automatic performance apparatus 20.

Figure 8:
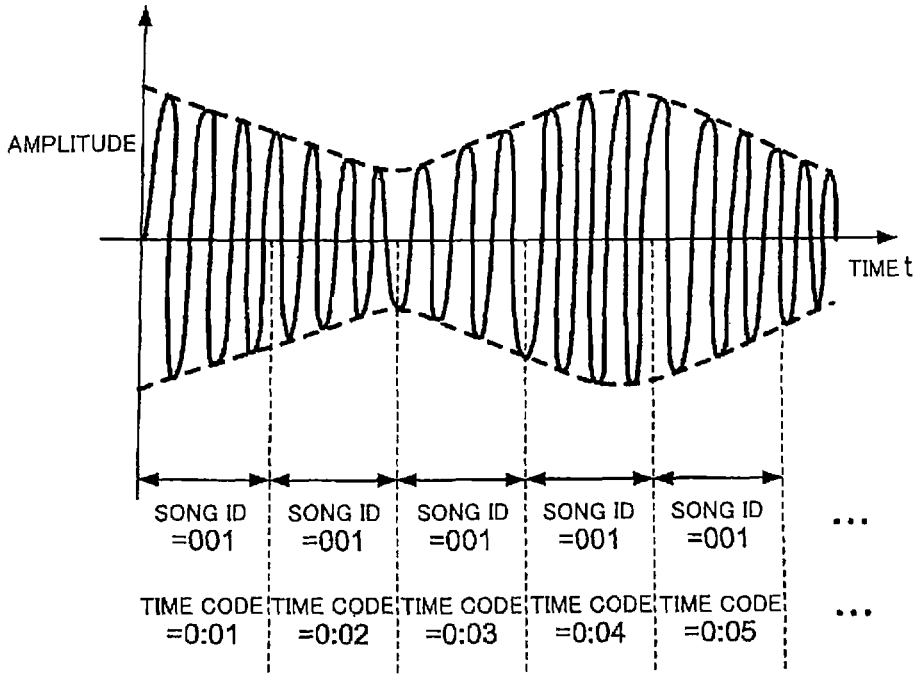
FIG. 8 is a graph explanatory of time-serial variation of the second tone signal.

FIG. 8 is a graph showing time-serial variation (i.e., variation over time) of the second tone signal output via the output interface 15. In the graph of FIG. 8, the horizontal axis represents the time t while the vertical axis represents the amplitude of the second tone signal. In FIG. 8, a waveform indicated by a solid line represents the second tone signal, and broken lines depicted therealong represent an envelope of the second tone signal.

As shown in FIG. 8, the second tone signal has embedded therein the watermark information that includes time codes indicative of reproduction times corresponding to individual signal sections each indicated by a double-headed arrow in the figure and the song ID. Because the second tone signal generated from one audio file Aud corresponds to a single music piece, the song ID in this case is "001" that is common to all of the signal sections. Further, the reproduction times indicated by the time codes are time-serially set, on a second-by-second basis, like "0:01", "0:02", . . . .

As a modified example of the tone signal supply apparatus 10, a second tone signal, obtained by embedding watermark information in the first tone signal, may be prestored in a storage section so that the second tone signal are read out from the storage section. Alternatively, such a second tone signal may be acquired from outside via a network or the like.

[Automatic Performance Apparatus 20]

Figure 9:
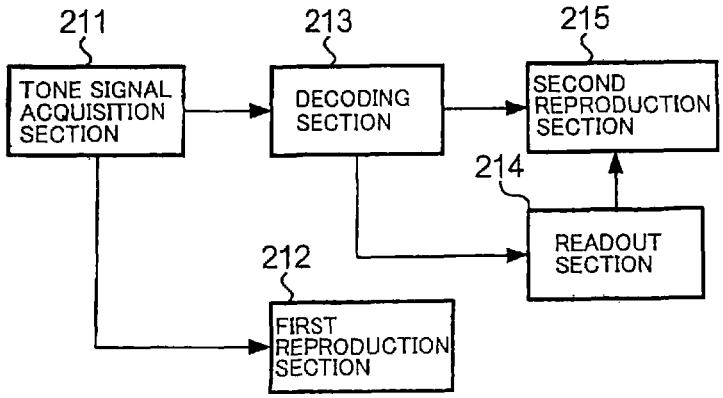
FIG. 9 is a functional block diagram indicative of functions implemented by a control section of the automatic performance apparatus.

Next, the functions implemented by the automatic performance apparatus 20 will be described. FIG. 9 is a functional block diagram indicative of the functions performed or implemented by the control section 21 of the automatic performance apparatus 20. The control section 21 executes a program to perform functions corresponding to a tone signal acquisition section 211, first reproduction section 212, decoding section 213, readout section 214 and second reproduction section 215.

The tone signal acquisition section 211 acquires the second tone signal, output from the tone signal supply apparatus 10, via the input interface 22. Namely, the tone signal acquisition section 211 is an example of an acquisition section of the present invention.

The first reproduction section 212 includes an LPF having, for example, a cutoff frequency fo and reproduces the second tone signal, acquired by the tone signal acquisition section 211, after performing a filtering process on the acquired second tone signal using the LPF. In this way, the first reproduction section 212 reproduces the second tone signal with the frequency components of the watermark information removed therefrom, and thus, ideally, the tone signal reproduced by the first reproduction section 212 is similar in content to the first tone signal. Namely, the first reproduction section 212 reproduces the second tone signal in such a manner that a tone corresponding to the first tone signal can be audibly generated via the speaker 24. Namely, the first reproduction section 212 is an example of an audio reproduction section of the present invention.

Note that, in the case where the frequency components of the watermark information are included in a frequency band outside the audible range or where the frequency components of the watermark information are of a low sound pressure level, there would be little auditory influence on a sound corresponding to the watermark information, and thus, the above-mentioned filtering process may be dispensed with. Namely, the first reproduction section 212 may reproduce the second tone signal (acquired by the tone signal acquisition section 211) directly or as-is.

The decoding section 213 includes an HPF (High Pass Filter) having, for example, a cutoff frequency fo and decodes the watermark information from the second tone signal. As noted above, the frequency components of the watermark information are included in a frequency band higher than the first tone signal. Thus, the decoding section 213 can take out the frequency components of the watermark information from the second tone signal by performing a filtering process on the second tone signal using the HPF. Then, the decoding section 213 decodes the signal taken out through the filtering process, to thereby decode the watermark information.

The readout section 214 identifies the song ID on the basis of the watermark information decoded by the decoding section 213 and reads out, from the MIDI file storage area 231, MIDI data associated with the identified song ID.

The second reproduction section 215 identifies, on the basis of the watermark information, content of music piece performance data to be reproduced in synchronism with the tone signal reproduced by the first reproduction section 212 and reproduces the identified content of music piece performance data. Of the MIDI data read out by the readout section 214, the second reproduction section 215 reproduces MIDI data of the reproduction times indicated by the time codes decoded from the watermark information decoded by the decoding section 213. In this way, the second reproduction section 215 can reproduce the content of the MIDI data corresponding to the reproduction times of the second tone signal in synchronism with the tone signal reproduced by the first reproduction section 212. For example, a comparison is made between the reproduction times indicated by the time codes and reproduction times of tones to be reproduced on the basis of the MIDI data, so that each tone (tone based on the MIDI data) corresponding to any one of the reproduction times indicated by the time codes is reproduced. The reproduction times (absolute times) of the MIDI data can be identified through accumulation of delta times. The storage section 23, readout section 214 and second reproduction section 215 constitute a tone reproduction section of the present invention. Further, the readout section 214 and second reproduction section 215 constitute a readout and reproduction section of the present invention.

Figure 10:
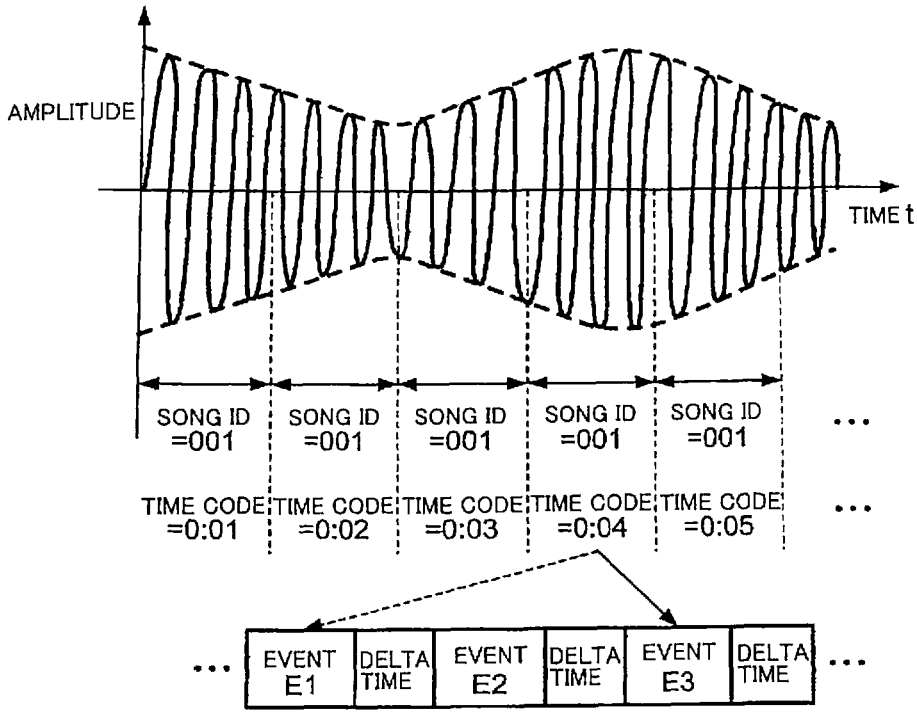
FIG. 10 is a diagram explanatory of processing by a second reproduction section in the automatic performance apparatus.

FIG. 10 is a diagram explanatory of processing by the second reproduction section 215. Once the second reproduction section 215 identifies a reproduction time, it identifies an event of MIDI data that corresponds to the identified reproduction time. Let it now be assumed that music piece performance data to be reproduced in synchronism with the tone signal when the reproduction time is, for example, "0:04" is event E3 as indicated by a double-headed arrow in the figure. In this case, the second reproduction section 215 reproduces the MIDI data on the basis of event data indicative of event E3. The processes performed by the decoding section 213, readout section 214 and second reproduction section 215 require a certain time. Thus, the second reproduction section 215 preferably reproduces MIDI data on the basis of event data earlier by the certain time (e.g., 100 ms) than the reproduction time identified from the watermark information. Further, in a case where reproduction timing of MIDI data and the second tone signal is different from each other, such as when the second reproduction section 215 is reproducing MIDI data on the basis of event data indicative of event E1, the second reproduction section 215 may achieve synchronized reproduction, for example, by skipping events E1 and E2 or making a tempo faster (i.e., making the delta time shorter).

The control section 11 not only executes the synchronized reproduction in the aforementioned manner, but also synthesizes a tone signal generated in response to human player's performance operation performed via the performance operation section 25 and then causes the speaker 24 to audibly generate or sound a tone corresponding to the synthesized tone signal. In addition, the control section 11 causes each corresponding key even to be depressed, even without human player's operation, by driving the drive circuit of the performance operation section 25 in accordance with reproduced MIDI date.

According to the above-described embodiment of the invention, the tone signal supply apparatus 10 embeds, into the first tone signal, watermark information to be used for synchronized reproduction of the first tone signal and MIDI data, and outputs, as the second tone signal, the signal embedded with the watermark information. The automatic performed apparatus 20 identifies, on the basis of the watermark information, content of MIDI data to be reproduced in synchronism with the second tone signal and reproduces the identified content of MIDI data and the second tone signal. Further, in a case where the second tone signal has been compressed by the tone signal supply apparatus 10 and automatic performed apparatus 20, and if part of the song ID and/or time codes has been lost, the instant embodiment permits continued reproduction of the MIDI data although it cannot identify content of the MIDI data only in a time period for which the part of the song ID and/or time codes has been lost; thus, the loss of the song ID and/or time codes does not so influence the synchronized reproduction.

In the above-described manner, the reproduction system 1 of the present invention can achieve synchronized reproduction of a tone signal and music piece performance data on the basis of information obtained from the tone signal.

[Modification]

The present invention may be modified variously as exemplified below without being limited to the above-described embodiment, and the following modifications may be combined as desired.

(Modification 1)

In the above-described embodiment, the tone signal supply apparatus 10 is constructed to embed, into the first tone signal, watermark information including a song ID and time codes. As a modification, the tone signal supply apparatus 10 may embed, into the first tone signal. MIDI data themselves as watermark information. In this case too, the watermark information is information indicative of content of MIDI data themselves that are to be reproduced in synchronism with the first tone signal. In this modification, MIDI files stored by the automatic performance apparatus 20 in the above-described embodiment may be stored by the tone signal supply apparatus 10; that is, the automatic performance apparatus 20 need not store MIDI files in the modification.

In this modification, the watermark information generation section 112 identifies content of MIDI data to be reproduced in synchronism with a first tone signal and generates, as watermark information, a bit sequence indicative of the identified content of MIDI data. The embedding section 114 embeds the thus-generated watermark information into the first tone signal in the same manner as described above in relation to the embodiment. The other processes performed by the tone signal supply apparatus 10 in the modification are the same as those described above in relation to the embodiment. Further, in this modification, the second reproduction section 215 of the automatic performance apparatus 20 identifies content of MIDI data on the basis of the watermark information decoded from the second tone signal and then reproduces the identified content of MIDI data.

With such arrangements. MIDI data to be reproduced in synchronism with the first tone signal can be designated in the tone signal supply apparatus 10, and thus, a new file need not be stored in the automatic performance apparatus 20. In this case, a data quantity of the watermark information may become greater than that in the above-described embodiment, and thus, a processing time required for embedding and decoding the watermark information may become longer than that in the above-described embodiment. However, in this case too, synchronized reproduction of the tone signal and MIDI data can be realized like in the above-described embodiment, by the second reproduction section 215 appropriately controlling reproduction times in consideration of the processing time required for embedding and decoding watermark information.

(Modification 2)

Whereas the tone signal supply apparatus 10 and the automatic performance apparatus 20 are interconnected via the audio cable 100 in the above-described embodiment, the reproduction system 10 may be modified as follows.

Figure 11:
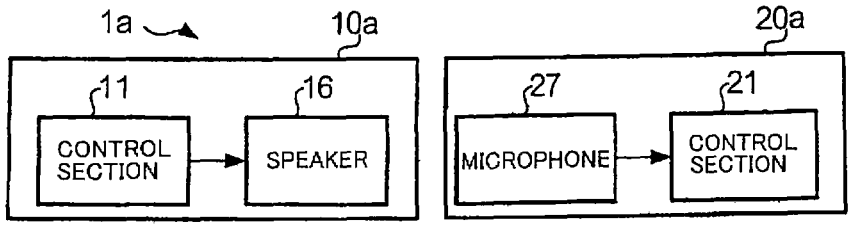
FIG. 11 is a block diagram showing a construction of a modification of the reproduction system.

FIG. 11 is a block diagram of the modified reproduction system 1*a*, which includes a tone signal supply apparatus 10*a* and an automatic performance apparatus 20*a*. In FIG. 11, the tone signal supply apparatus 10*a* includes components similar to those of the tone signal supply apparatus 10 except for the control section 11, and the automatic performance apparatus 20*a* includes components similar to those of the automatic performance apparatus 20 except for the control section 21.

The tone signal supply apparatus 10*a* includes, in place of the output interface 15 employed in the above-described embodiment, a speaker 16 detachably attachable, for example, to the apparatus 10*a*. The speaker 16 is a sounding device that audibly generates a tone in response to a tone signal supplied from the control section 11. The automatic performance apparatus 20*a* includes, in place of the input interface 22 employed in the above-described embodiment, a microphone 27 detachably attachable, for example, to the apparatus 20*a*. The microphone 27 is a sound pickup device that picks up a sound and outputs a sound signal indicative of the picked-up sound. The tone signal supply apparatus 10*a* and the automatic performance apparatus 20*a* are disposed somewhat close to each other in such a manner that a sound audibly generated via the speaker 16 can be picked up by the microphone 27.

In this modification, the control section 11 of the tone signal supply apparatus 10*a* outputs the generated second tone signal to the speaker 16 to cause the speaker 16 to audibly generate a tone corresponding to the second tone signal. The control section 21 of the automatic performance apparatus 20*a* causes the microphone 27 to pick up the tone audibly generated by the speaker 16 and acquires, as the second tone signal, an audio signal indicative of the picked-up tone. The control section 21 realizes synchronized reproduction as in the above-described embodiment by decoding the watermark information from the second tone signal in the same manner as in the above-described embodiment. The other processes are the same as those explained in relation to the above-described embodiment. Thus, the instant modification achieves the same advantageous benefits as the above-described embodiment.

Figure 12:
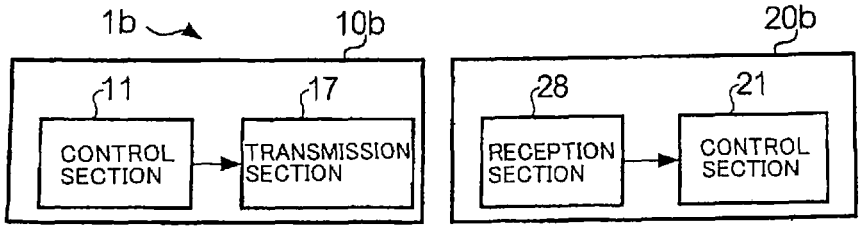
FIG. 12 is a block diagram showing a construction of a modification of the reproduction system.

Further, the reproduction system 1 of the present invention may be modified as follows. FIG. 12 is a block diagram showing the modified reproduction system 1*b*, which includes a tone signal supply apparatus 10*b* and an automatic performance apparatus 20*b*. The tone signal supply apparatus 10*b* includes components similar to those of the tone signal supply apparatus 10 except for the control section 11, and the automatic performance apparatus 20*b* includes components similar to those of the automatic performance apparatus 20 except for the control section 21.

The tone signal supply apparatus 10*b* is constructed as a transmitter having a function for transmitting the second tone signal, which is, for example a transmitter of a broadcasting station. The automatic performance apparatus 20*b* is a receiver having a function for receiving the second tone signal transmitted by the tone signal supply apparatus 10*b* and is possessed by a user who listens to sounds broadcast by a broadcasting apparatus. The tone signal supply apparatus 10*b* includes a transmission section 17 in place of the output interface 15 employed in the above-described embodiment. The transmission section 17 modulates a carrier wave signal, indicative of a carrier wave, in accordance with the second tone signal supplied from the control section 11 to thereby generate a transmission signal and then transmits the transmission signal. The automatic performance apparatus 20*b* includes a reception section 28 in place of the input interface 22 employed in the above-described embodiment. Once the reception section 28 receives the transmission signal transmitted by the tone signal supply apparatus 10*b*, it demodulates the transmission signal to take out the second tone signal and outputs the second tone signal to the control section 21. The control section 21 decodes, from the second tone signal, the watermark information in the same manner as in the above-described embodiment, to thereby realize the synchronized reproduction. The other processes are the same as those explained in relation to the above-described embodiment. Thus, the instant modification achieves the same advantageous benefits as the above-described embodiment.

With the aforementioned modification, a user who possesses the automatic performance apparatus 20*b* can use the apparatus 20*b* to enjoy synchronized performance (synchronized reproduction) with a tone indicated by a tone signal output from the tone signal supply apparatus 10*b* located remotely from the automatic performance apparatus 20*b*. On the other hand, even a user who does not possess the automatic performance apparatus 20*b* will not substantially suffer from adverse influence in listening to the tone.

Further, the basic principles of the present invention are applicable to services in which the tone signal supply apparatus 10*b* and the automatic performance apparatus 20*b* are interconnected via a communication network, such as the Internet, and which compress audio data etc. to deliver sounds and animations. In this case, the tone signal supply apparatus 10*b* is a server apparatus, such as a content provider. The automatic performance apparatus 20*b* is possessed by a client that receives content from a content provider. In this case, the tone signal supply apparatus 10*b* embeds watermark information into the second tone signal included in content to be delivered, and it transmits the second tone signal having the watermark information embedded therein. Then, the automatic performance apparatus 20*b* decodes the watermark information from the second tone signal received from the tone signal supply apparatus 10*b*, to thereby realize the synchronized reproduction.

(Modification 3)

The construction for the tone signal supply apparatus 10 to embed watermark information in the above-described embodiment may be modified as follows. For example, there may be employed a method that employs pseudo noise signals using any of the M and Gold sequences. In this case, the embedding section 114 generates a pseudo noise signal and phase-modulates the thus-generated pseudo noise signal on the basis of watermark information. The decoding section 213 generates the same pseudo noise signal as the embedding section 114 and determines a correlation between the pseudo noise signal and the second tone signal. In a case where a signal having a high autocorrelation is used as the pseudo noise signal to be embedded into the second tone signal, and if a correlation between the second tone signal and the pseudo noise signal is determined, a waveform where a steep peak appears is extracted. This waveform indicates watermark information, and the decoding section 213 can decode the watermark information by extracting the waveform. Further, spectrum spreading may be performed using the pseudo noise signal, or the watermark information may be embedded using the OFDM (Orthogonal Frequency-Division Multiplexing) modulation. In the latter case, the control section 11 removes part of a high-frequency band of frequency components of the first tone signal and then embeds the OFDM-modulated watermark information into the frequency band in accordance with a frequency distribution of the original tone signal. Even with such an embedding scheme, the instant modification can achieve the same advantageous benefits as the above-described embodiment because the tone signal supply apparatus 10 embeds the watermark information into a high-frequency band higher than the frequency components of the first tone signal.

In the above-described embodiment, the format of music piece performance data performance data to be reproduced by the automatic performance apparatus 20 may be other than the MIDI data format, such as the MP-3 format. Whereas the automatic performance apparatus 20 has been described above as being an electronic piano having an automatic performance function, it may be any other type of electronic musical instrument, such as an electric-acoustic guitar or electone (registered trademark). Further, the automatic performance apparatus 20 is not limited to an apparatus functioning as an electronic musical instrument, and the basic principles of the present invention are also applicable to a reproduction apparatus having at least a function for reproducing music piece performance data while reproducing a tone signal.

Furthermore, in the above-described embodiment, the function corresponding to the pre-processing section 113 may be dispensed with. Because, in a case where frequency components of a tone signal are not contained in a frequency band higher the frequency fo or where frequency components of a tone signal are considerably smaller in sound pressure level than frequency components of watermark information, for example, it is considered that there will be almost no auditory influence and almost no auditory influence on decoding of the watermark information even if the pre-processing is dispensed with.

The programs for execution by the control section 11 of the tone signal supply apparatus 10 and by the control section 21 of the automatic performance apparatus 20 may be provided stored in a computer-readable recording or storage medium, such as a magnetic recording medium (e.g., magnetic tape, or magnetic disk like an HDD or FD), optical recording medium (e.g., optical disk like a CD or DVD), optical-magnetic recording medium or semiconductor memory. Further, such programs may be downloaded via a network, such as the Internet. Furthermore, the functions to be performed by the control sections 11 and 21 may be implemented by one or a plurality of software, or one or a plurality of hardware.

This application is based on, and claims priority to, JP PA 2010-007150 filed on 15 Jan. 2010. The disclosure of the priority application, in its entirety, including the drawings, claims, and the specification thereof, are incorporated herein by reference.

What is claimed is:

1. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

wherein a plurality of the watermark information is embedded in correspondence with a plurality of reproduction time positions along a time axis of the first audio signal, and each of the watermark information identifies at least one tone.

2. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content; and wherein the content of the music piece performance data indicated by the watermark information includes identification information identifying a music piece, and position information indicative of reproduction time positions of the music piece identified by the identification information, said tone reproduction section includes:

a storage section which stores therein the music piece performance data; and a readout and reproduction section which reads out, from said storage section, the music piece performance data of the music piece identified by the identification information included in the decoded watermark information and then reproduces a tones signal, corresponding to any one of the reproduction time positions indicated by the position information included in the watermark information, on the basis of the read-out music piece performance data.

3. The tone reproduction apparatus as claimed in claim 2, wherein said readout and reproduction section compares the reproduction time positions indicated by the position information and reproduction time positions of the tone signal based on the music piece performance data, and then reproduces a tone signal based on music piece performance data corresponding to any one of the reproduction time positions indicated by the position information.

4. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

wherein the content of the music piece performance data indicated by the watermark information includes the music piece performance data themselves individually indicative of tones to be performed, and said tone reproduction section reproduces a tone signal on the basis of the music piece performance data themselves included in the decoded watermark information.

5. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

wherein said acquisition section is constructed to receive the second audio signal supplied from outside.

6. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

which further comprises:

an embedding section which embeds the watermark information, indicative of the content of the music piece performance data to be reproduced in synchronism with the first audio signal, into the first audio signal in such a manner as to be positioned in a frequency band higher than the frequency components of the first audio signal; and an output section which outputs, as the second audio signal, the first audio signal having the watermark information embedded therein by said embedding section, said acquisition section acquiring the second audio signal outputted by said output section.

7. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

wherein said audio reproduction section extracts the first audio signal from the second audio signal and reproduces the extracted first audio signal.

8. A tone reproduction apparatus for reproducing a first audio signal and a tone signal, based on music piece performance data, in synchronism with each other, said tone reproduction apparatus comprising:

an acquisition section which acquires a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

an audio reproduction section which reproduces the first audio signal on the basis of the second audio signal;

a decoding section which decodes the watermark information from the second audio signal acquired by said acquisition section;

a tone reproduction section which identifies, on the basis of the watermark information decoded by said decoding section, content of the music piece performance data to be reproduced and reproduces the tone signal based on the music piece performance data in accordance with the identified content;

where the frequency band where the watermark information is embedded is a non-audible frequency band, and said audio reproduction section reproduces the second audio signal by reproducing the second audio signal as-is.

9. A computer-implemented method for reproducing a first audio signal and a tone signal, based on music piece performance data, in synchronism with each other, said method comprising:

an acquisition step of acquiring a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

a step of reproducing the first audio signal on the basis of the second audio signal;

a decoding step of decoding the watermark information from the second audio signal acquired by said acquisition step; and a step of identifying, on the basis of the watermark information decoded by said decoding step, content of the music piece performance data to be reproduced and reproducing the tone signal based on the music piece performance data in accordance with the identified content;

wherein a plurality of the watermark information is embedded in correspondence with a plurality of reproduction time positions along a time axis of the first audio signal, and each of the watermark information identifies at least one tone.

10. A computer-readable storage medium containing a program for causing a computer to perform a for reproducing a first audio signal and a tone signal, based on music piece performance data, in synchronism with each other, said tone reproduction apparatus comprising:

an acquisition step of acquiring a second audio signal, the second audio signal being an audio signal obtained by embedding, into the first audio signal, watermark information indicative of content of the music piece performance data to be reproduced in synchronism with the first audio signal, the watermark information being embedded in the first audio signal in such a manner as to be positioned in a frequency band higher than frequency components of the first audio signal;

a step of reproducing the first audio signal on the basis of the second audio signal;

a decoding step of decoding the watermark information from the second audio signal acquired by said acquisition step; and a step of identifying, on the basis of the watermark information decoded by said decoding step, content of the music piece performance data to be reproduced and reproducing the tone signal based on the music piece performance data in accordance with the decoded watermark information;

wherein a plurality of the watermark information is embedded in correspondence with a plurality of reproduction time positions along a time axis of the first audio signal, and each of the watermark information identifies at least one tone.

11. A tone signal supply apparatus comprising:

an embedding section which embeds watermark information, indicative of content of music piece performance data to be reproduced in synchronism with a first audio signal, into the first audio signal in such a manner as to be positioned in a frequency band higher than frequency components of the first audio signal; and an output section which outputs a second audio signal obtained by said embedding section embedding the watermark information into the first audio signal;

wherein a plurality of the watermark information is embedded in correspondence with a plurality of reproduction time positions along a time axis of the first audio signal, and each of the watermark information identifies at least one tone.

12. A tone reproduction system comprising:

an embedding section which embeds watermark information, indicative of content of music piece performance data to be reproduced in synchronism with a first audio signal, into the first audio signal in such a manner as to be positioned in a frequency band higher than frequency components of the first audio signal;

an output section which outputs a second audio signal obtained by said embedding section embedding the watermark information into the first audio signal;

an acquisition section which acquires the second audio signal outputted by said output section;

an audio reproduction section which reproduces the first audio signal on the basis of the second audio signal;

a decoding section which decodes the watermark information from the second audio signal acquired by said acquisition section; and a tone reproduction section which identifies, on the basis of the watermark information decoded by said decoding section, content of the music piece performance data to be reproduced and reproduces the tone signal based on the music piece performance data in accordance with the identified content;

wherein a plurality of the watermark information is embedded in correspondence with a plurality of reproduction time positions along a time axis of the first audio signal, and each of the watermark information identifies at least one tone.

13. A computer-implemented method for reproducing a first audio signal and a tone signal, based on music piece performance data, in synchronism with each other, said method comprising:

an embedding step of embedding watermark information, indicative of content of music piece performance data to be reproduced in synchronism with a first audio signal, into the first audio signal in such a manner as to be positioned in a frequency band higher than frequency components of the first audio signal;

an output step of outputting a second audio signal obtained by said embedding step embedding the watermark information into the first audio signal;

an acquisition step of acquiring the second audio signal outputted by said output step;

a step of reproducing the first audio signal on the basis of the second audio signal;

a decoding step of decoding the watermark information from the second audio signal acquired by said acquisition step; and a step of identifying, on the basis of the watermark information decoded by said decoding step, content of the music piece performance data and reproducing the tone signal based on the music piece performance data in accordance with the identified content;

wherein a plurality of the watermark information is embedded in correspondence with a plurality of reproduction time positions along a time axis of the first audio signal, and each of the watermark information identifies at least one tone.

* * * * *